US009445179B2

(12) United States Patent
Bowen et al.

(10) Patent No.: US 9,445,179 B2
(45) Date of Patent: Sep. 13, 2016

(54) EARBUDS CONDUIT

(71) Applicants: Linda Bowen, Houston, TX (US); Lillian Bowen Osowski, Houston, TX (US)

(72) Inventors: Linda Bowen, Houston, TX (US); Lillian Bowen Osowski, Houston, TX (US)

( * ) Notice: Subject to any disclaimer, the term of this patent is extended or adjusted under 35 U.S.C. 154(b) by 0 days.

(21) Appl. No.: 14/296,455

(22) Filed: Jun. 5, 2014

(65) Prior Publication Data

US 2015/0358714 A1 Dec. 10, 2015

(51) Int. Cl.
*H04R 25/00* (2006.01)
*H04R 1/10* (2006.01)

(52) U.S. Cl.
CPC ..... *H04R 1/1033* (2013.01)

(58) Field of Classification Search
CPC . H04R 1/1033; H04R 1/1066; H04R 1/1075
USPC ..... 381/370, 374, 380, 384, 386
See application file for complete search history.

(56) References Cited

U.S. PATENT DOCUMENTS

| | | | | |
|---|---|---|---|---|
| 5,388,275 | A | 2/1995 | Oram | |
| 5,545,128 | A | 8/1996 | Hayes et al. | |
| 8,147,270 | B1 * | 4/2012 | Wescott | B65H 75/36 174/135 |
| 2013/0022226 | A1 | 1/2013 | Anderson | |
| 2013/0336515 | A1 * | 12/2013 | Centrilla, III | H04R 1/1033 381/384 |

* cited by examiner

*Primary Examiner* — Sunita Joshi
(74) *Attorney, Agent, or Firm* — Chamberlain Hrdlicka

(57) ABSTRACT

The growing personal music player industry has resulted in more and more consumers using the in-ear "earbuds" to listen to their music. While the "earbud" headphone design varies slightly from one manufacturer to another the same basic characteristics are consistent. A plug is used to connect the headphones to the music player. A wire running from the plug to a point where the two "earbuds" split is referred to as the "y-junction". From the y-junction a single wire terminates with the earbud itself. One main benefit of this type of headphone versus the conventional over-the-ear headphones is the compact design and ability to store them when not in use. However, when stored, the wires tend to become tangled and crimped, making them difficult to readily access. This invention will address the problem by placing the wire portion of the headphone in a continuous conduit that will make tangling nearly impossible. The conduit will be designed as an aftermarket product that can accommodate nearly all types of earbuds.

17 Claims, 7 Drawing Sheets

EARBUDS CONDUIT

CROSS-REFERENCE TO RELATED APPLICATION

This application is claiming benefit from the previously filed provisional patent application with the Application No. 61/831,084 with a filing date of Jun. 4, 2013

FIELD OF THE INVENTION

The present invention generally relates to a wire management system for the use with earbud-style headphones.

BACKGROUND OF THE INVENTION

More and more people are adopting the use of earbud-style headphones in place of the over-the-head style. One particular issue with this style of headphone is that while they take up less space, the wires often become tangled when stored. This leads to problems with wire wear and tear and ultimately functionality. The typical earbud design comprises two individual ear "buds" with single wires that feed into a plug that connects to the audio device. The outer wire sheathing is a rubber material that has a high friction factor. When the wires become tangled, the high friction of the rubber sheathing makes untangling time consuming and difficult. Additionally, the earbud wiring is typically black or white with no ability for customization.

The present invention helps to satisfy all of these problems by creating a durable conduit for which the earbud wires are housed. This conduit not only has a much lower friction factor but, also can be customized with different material colors and optional components. The present invention is intended to be a complimentary product that can be installed over the users existing earbuds.

SUMMARY OF THE INVENTION

The present invention is a series of hollow fabric tubing's that are joined in a central y-junction. The base fabric of the invention is one that has a significant amount of elasticity to accommodate the various sizes and shapes of earbuds when installed. Each earbud resides within its own tubing to ensure that wire entanglement is minimized. The y-junction has a flap that when closed, conceals the wires from view. The y-junction serves as the passage way whereby the earbud and plug can be feed through their respective tubing's.

Other features and advantages of the present invention will become apparent from the following more detailed description, when taken into conjunction with the accompanying drawings, which illustrate, by way of example, the principles of the invention.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention generally provides a method of containing the wires of an earbud-design headphone assembly for the purpose of reducing tangling. By placing the earbud wires in a continuously cylindrical conduit the wires are less likely to become tangled during storage.

Figure 1:
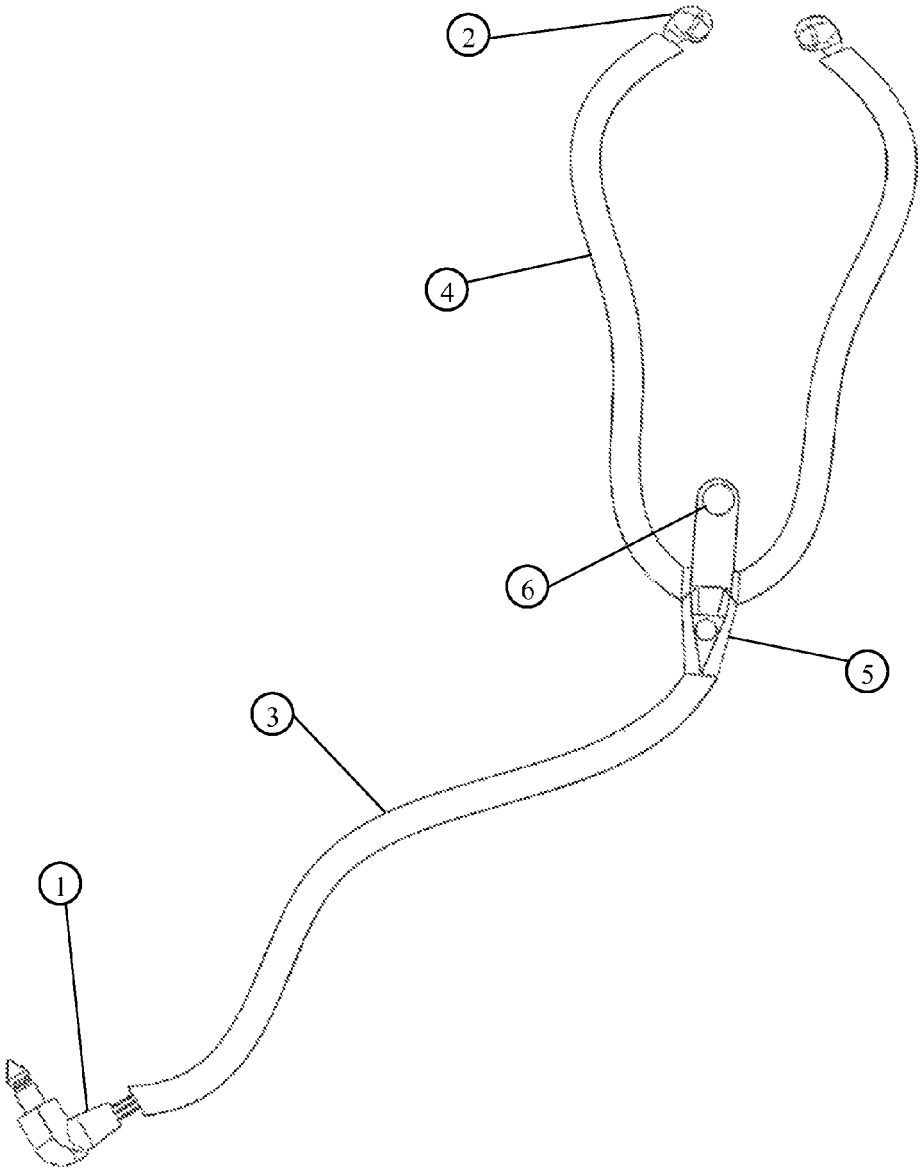
FIG. 1 shows an installed view of an exemplary embodiment of the invention.

FIG. 1 shows an installed view of an exemplary embodiment of the invention. Two earbud wire conduits (4) are joined to a single plug wire conduit (3) with a y-junction (5). The plug conduit (3) houses the earbud plug wire, which ultimately terminates with the plug (1). The earbud conduits (4) house each individual earbud wires, which ultimately terminate with the earbud (2). The y-junction (5) is attached to the earbud conduits (4) and plug conduit (3) creating a method for feedings the earbuds (2) and plug (1) through the fabric conduits. A closure mechanism (6) on the y-junction and flap provide a means for concealing the wiring once installed.

Figure 2:
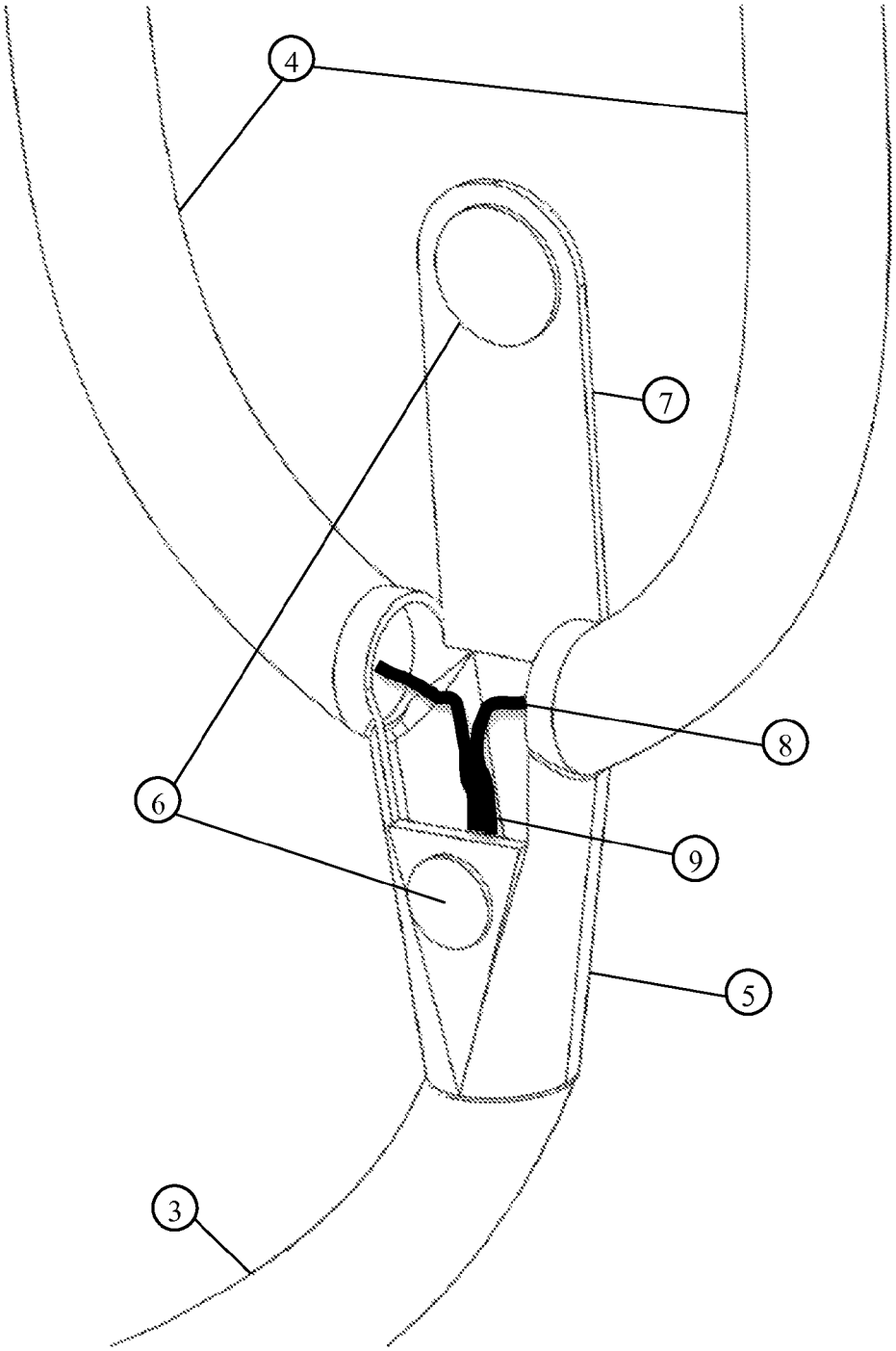
FIG. 2 shows the close up of the y-junction of the conduit where the wires are fed through of the exemplary embodiment of the invention from FIG. 1.

FIG. 2 shows the close up of the y-junction of the conduit of an exemplary embodiment of the invention. The invention may include two earbud wire conduits (4) attached to a central y-junction (5). The earbud wire conduit (4) house each individual earbud wire (8). The invention also has extending from the bottom of the y-junction (5), a plug wire conduit (3). The plug wire conduit (3) houses the plug wiring (9). The y-junction flap (7) has an integral closure mechanism such as a magnet (6) which when joined together with the attractive magnet (6) found on the body of the y-junction (5) conceals the wiring from view.

Figure 3:
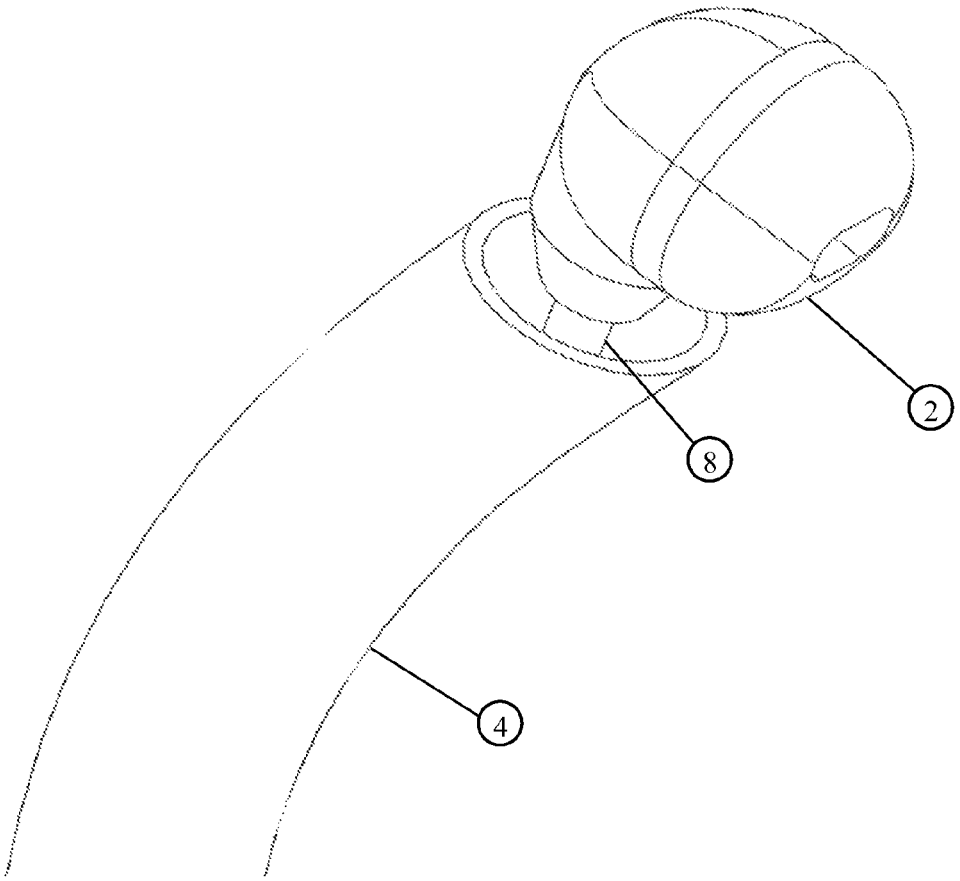
FIG. 3 shows the close up of the installed earbud within the earbud wire conduit illustrated in FIG. 1.

FIG. 3 shows the close up of the installed earbud within the earbud conduit illustrated in FIG. 1. In the installed position, the earbud (2) is shown protruding from the earbud wire conduit (4). The earbud wire conduit (4) is shown around the earbud wiring (8).

Figure 4:
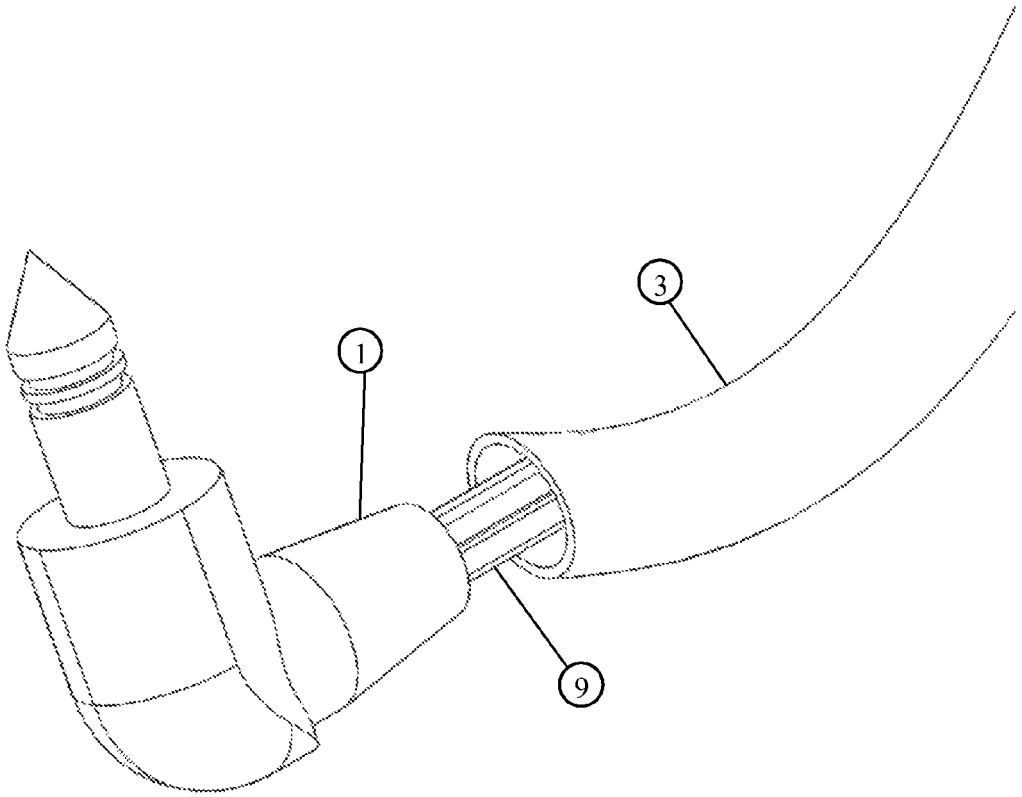
FIG. 4 shows the close up of the installed earbud plug within the earbud plug wire conduit illustrated in FIG. 1.

FIG. 4 shows the close up of the installed earbud plug within the earbud plug wire conduit illustrated in FIG. 1. In the installed position, the earbud plug (1) is shown protruding from the earbud plug wire conduit (3). The earbud plug wire conduit (3) is shown around the plug wiring (9).

Figure 5:
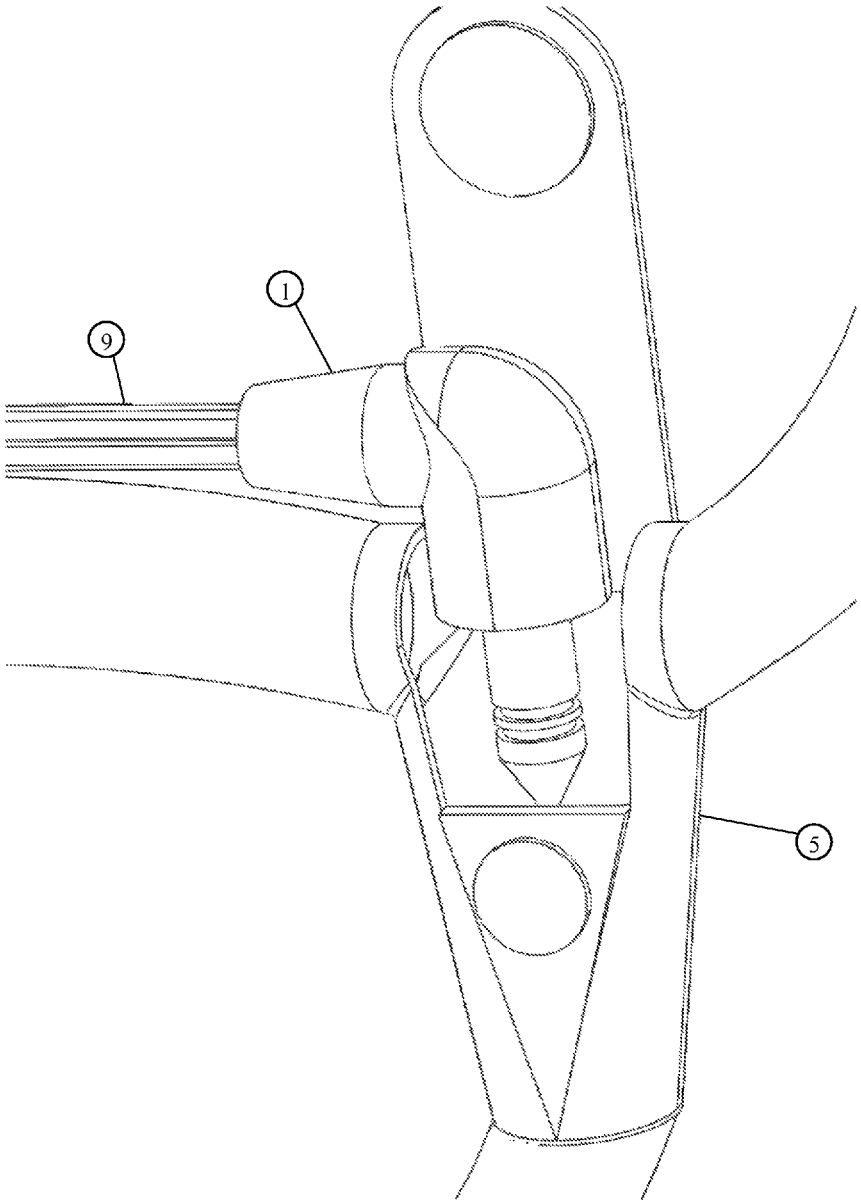
FIG. 5 shows the installation of the earbud plug through the y-junction.

FIG. 5 shows the installation of the earbud plug through the y-junction. The earbud plug (1) is fed through the internal passageway of the y-junction (5) followed by the earbud plug wiring (9).

Figure 6:
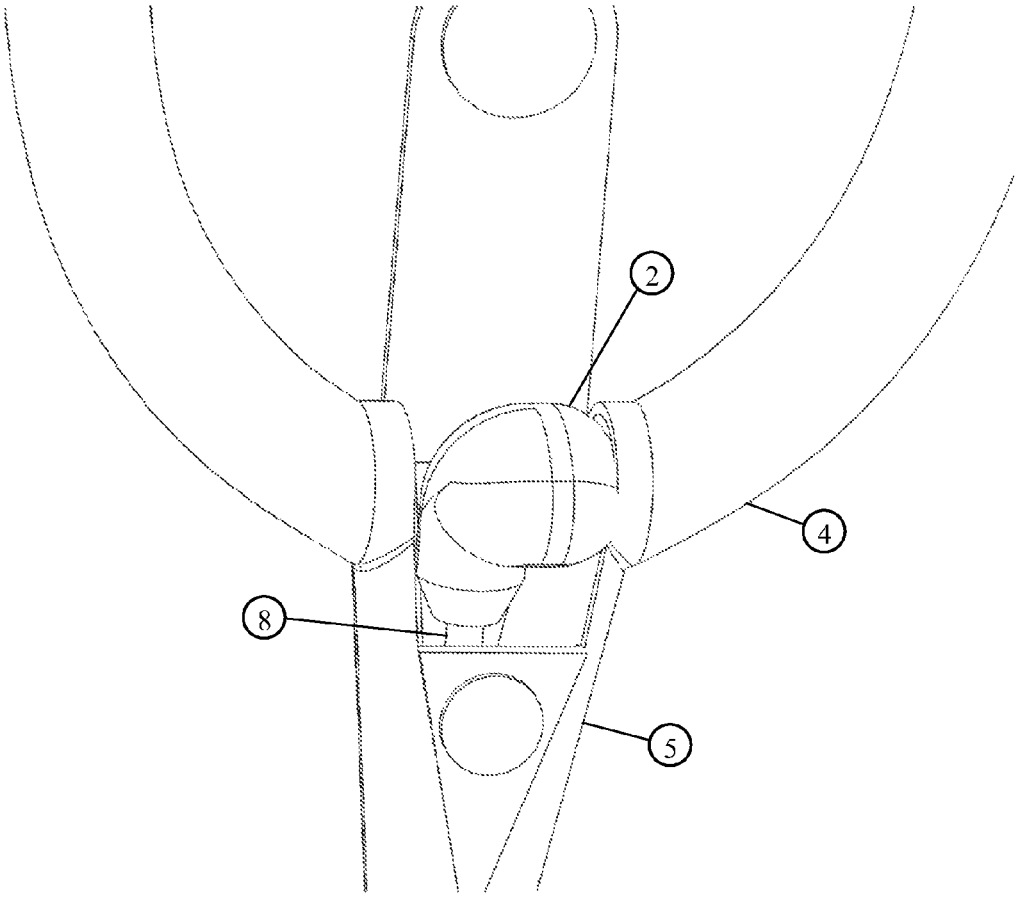
FIG. 6 shows the installation of the earbud through the y-junction.

FIG. 6 shows the installation of the earbud through the y-junction. The earbud (2) is fed through the internal passageway of the y-junction (5) connecting to the earbud wire conduit (4).

Figure 7:
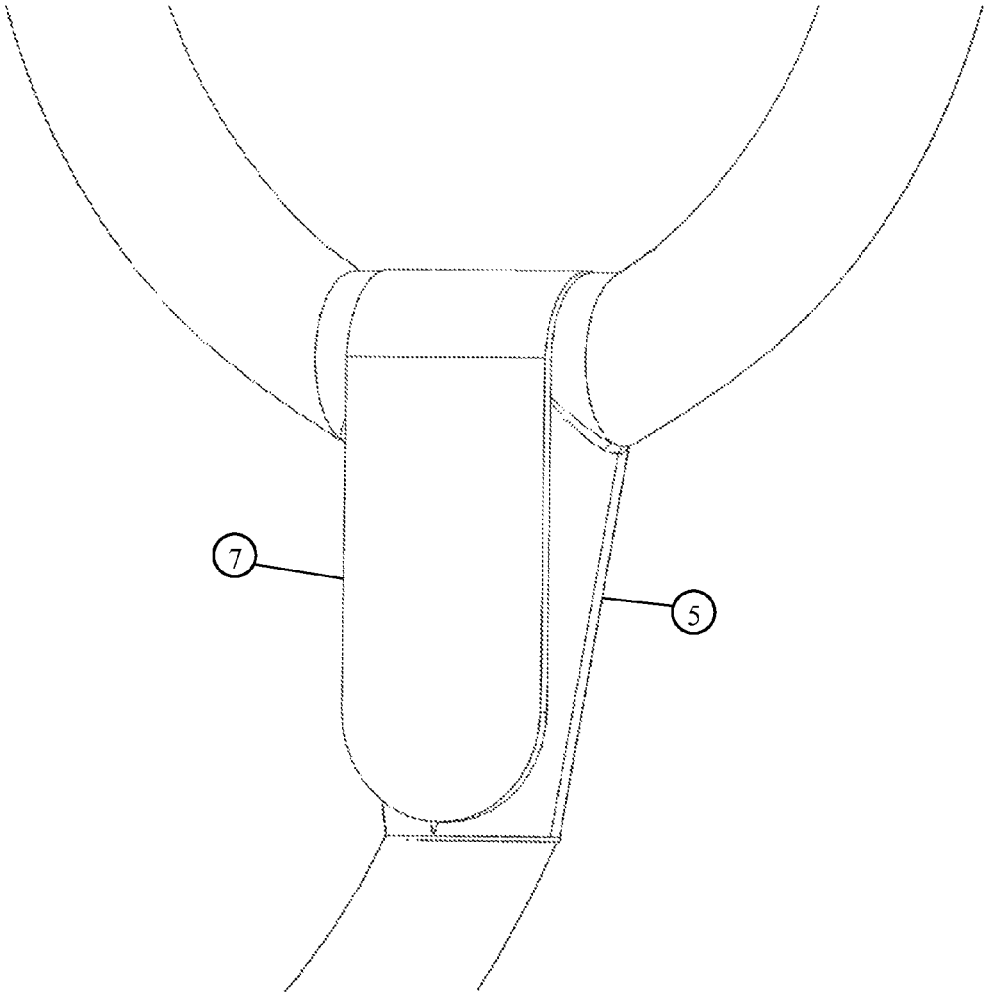
FIG. 7 shows the y-junction in the with the flap in the closed position.

FIG. 7 shows the y-junction in with the flap in the closed position. The y-junction flap (7) is joined to the body of the y-junction (5) to conceal wiring when fully installed.

In an exemplary embodiment, the conduit can be used with all earbud designs and is adaptable in length by way of the tubing material that can stretch and contract to the desired length.

It should be understood, of course, that the foregoing relates to an exemplary embodiments of the invention and that modifications may be made without departing from the spirit and scope of the invention as set forth in the following claim.

The invention claimed is:

1. A wire management device for earbud headphones, comprising:

a hollow, primary tubing configured to house a plug wire;

a pair of hollow, secondary tubings, each configured to house an earbud wire;

a y-junction comprising an opening to receive the earbud headphones through the y-junction with the hollow, primary tubing and each of the hollow, secondary tubings extending from the y-junction; and a flap movably connected to the y-junction between a closed position and an open position, the flap configured to cover the opening of the y-junction in the open position and uncover the opening of the y-junction in the closed position.

2. The wire management device of claim 1, wherein the hollow, primary tubing or the hollow, secondary tubings comprise a material that is configured to stretch radially.

3. The wire management device of claim 1, further comprising an elastic band positioned at an end of each of the hollow, secondary tubings and configured to retain the earbud wires.

4. The wire management device of claim 1, wherein the y-junction is configured to receive a plug and the plug wire therethrough for the wire plug to be housed within the hollow, primary tubing.

5. The wire management device of claim 1, wherein the y-junction is configured to receive each earbud and earbud wire therethrough for the earbud wires to be housed within the hollow, secondary tubings.

6. A wire management device for earbud headphones, comprising:

a hollow, primary tubing configured to house a plug wire;

a pair of hollow, secondary tubings, each configured to house an earbud wire;

a y-junction comprising an opening to receive the earbud headphones through the y-junction with the hollow, primary tubing and each of the hollow, secondary tubings extending from the y-junction; and a flap with a magnetic closure movably connected to the y-junction between a closed position and an open position, the flap configured to cover the opening of the y-junction in the open position and uncover the opening of the y-junction in the closed.

7. The wire management device of claim 6, wherein the hollow, primary tubing or the hollow, secondary tubings comprise a material that is configured to stretch radially.

8. The wire management device of claim 6, further comprising an elastic band positioned at an end of each of the hollow, secondary tubings and configured to retain the earbud wires.

9. The wire management device of claim 6, wherein the y-junction is configured to receive a plug and the plug wire therethrough for the wire plug to be housed within the hollow, primary tubing.

10. The wire management device of claim 6, wherein the y-junction is configured to receive each earbud and earbud wire therethrough for the earbud wires to be housed within the hollow, secondary tubings.

11. A wire management device for earbud headphones, comprising:

a hollow, primary tubing configured to house a plug wire;

a pair of hollow, secondary tubings, each configured to house an earbud wire;

a y-junction comprising an opening to receive the earbud headphones through the y-junction with the hollow, primary tubing and each of the hollow, secondary tubings extending from the y-junction; and a flap with a snap-type closure movably connected to the y-junction between a closed position and an open position, the flap configured to cover the opening of the y-junction in the open position and uncover the opening of the y-junction in the closed position.

12. The wire management device of claim 11, wherein the hollow, primary tubing or the hollow, secondary tubings comprise a material that is configured to stretch radially.

13. The wire management device of claim 11, further comprising an elastic band positioned at an end of each of the hollow, secondary tubings and configured to retain the earbud wires.

14. The wire management device of claim 11, wherein the y-junction is configured to receive a plug and the plug wire therethrough for the wire plug to be housed within the hollow, primary tubing.

15. The wire management device of claim 11, wherein the y-junction is configured to receive each earbud and earbud wire therethrough for the earbud wires to be housed within the hollow, secondary tubings.

16. The wire management device of claim 1, wherein the flap comprises Velcro™.

17. The wire management device of claim 1, wherein the hollow, primary tubing or the hollow, secondary tubings comprise a fabric material.

* * * * *